US007742021B2

(12) United States Patent
Shin

(10) Patent No.: US 7,742,021 B2
(45) Date of Patent: Jun. 22, 2010

(54) ORGANIC ELECTROLUMINESCENT DISPLAY AND DEMULTIPLEXER

(75) Inventor: Dong-Yong Shin, Seoul (KR)

(73) Assignee: Samsung Mobile Display Co., Ltd., Yongin, Gyunggi-Do (KR)

( * ) Notice: Subject to any disclaimer, the term of this patent is extended or adjusted under 35 U.S.C. 154(b) by 747 days.

(21) Appl. No.: 11/136,713

(22) Filed: May 25, 2005

(65) Prior Publication Data

US 2005/0270258 A1 Dec. 8, 2005

(30) Foreign Application Priority Data

Jun. 7, 2004 (KR) ..... 10-2004-0041259

(51) Int. Cl.
*G09G 3/32* (2006.01)

(52) U.S. Cl. ..... 345/76; 345/82

(58) Field of Classification Search ..... 345/76, 345/82, 204; 315/169.1, 169.3
See application file for complete search history.

(56) References Cited

U.S. PATENT DOCUMENTS

| | | | | |
|---|---|---|---|---|
| 5,170,158 | A * | 12/1992 | Shinya | 345/98 |
| 6,787,249 | B2 | 9/2004 | Seo | |
| 6,806,854 | B2 * | 10/2004 | Cairns et al. | 345/87 |
| 6,924,784 | B1 * | 8/2005 | Yeo et al. | 345/98 |
| 7,079,125 | B2 * | 7/2006 | Nakagawa et al. | 345/209 |
| 2001/0050665 | A1 * | 12/2001 | Yeo et al. | 345/87 |
| 2003/0132907 | A1 * | 7/2003 | Lee et al. | 345/98 |
| 2003/0179164 | A1 * | 9/2003 | Shin et al. | 345/76 |
| 2004/0145556 | A1 * | 7/2004 | Nakanishi | 345/99 |

FOREIGN PATENT DOCUMENTS

| | | |
|---|---|---|
| CN | 1447302 | 10/2003 |
| JP | 2003-157048 | 5/2003 |
| JP | 2003-195812 | 7/2003 |
| JP | 2004-029755 | 1/2004 |
| JP | 2004-029791 | 1/2004 |

OTHER PUBLICATIONS

Chinese Office action corresponding to Chinese Patent Application No. 200510076394.X, issued on Dec. 7, 2007.
Office action from the Japanese Patent Office issued in Applicant's corresponding Japanese Patent Application 2005-158977 dated Jun. 3, 2008.

* cited by examiner

*Primary Examiner*—Amr Awad
*Assistant Examiner*—Stephen G Sherman
(74) *Attorney, Agent, or Firm*—Robert E. Bushnell, Esq.

(57) ABSTRACT

An organic electroluminescent display and a demultiplexer, wherein the organic electroluminescent display comprising: a plurality of pixels displaying an image corresponding to output data current; a plurality of scan lines to transmit a scan signal to the plurality of pixels; a plurality of output data lines to transmit the output data current to the plurality of pixels; a scan driver outputting the scan signal to the plurality of scan lines; a demultiplexer comprising a plurality of demultiplexing circuit; and a data driver outputting input data current to the demultiplexer, wherein the demultiplexing circuit transmits the input data current after applying pre-charging voltage to the output data line selected among the output data lines in sequence. With this configuration, the present invention provides an organic electroluminescent display and a demultiplexer, in which comprises a current programming type pixel circuit uniformizing brightness of a screen even if threshold voltage is not uniform, and the demultiplexer placed between a data driver and an organic electroluminescent display panel, thereby reducing time taken to program data of a current programming type pixel.

16 Claims, 8 Drawing Sheets

ORGANIC ELECTROLUMINESCENT DISPLAY AND DEMULTIPLEXER

CLAIM OF PRIORITY

This application makes reference to, incorporates the same herein, and claims all benefits accruing under 35 U.S.C §119 from an application entitled Organic Electroluminescent Display And Demultiplexer earlier filed in the Korean Industrial Property Office on Jun. 7, 2004, and there duly assigned Korean Patent Application No. 2004-41259, by that office.

BACKGROUND

1. Field of the Invention

The present invention relates to an organic electroluminescent display and a demultiplexer, and more particularly, to an organic electroluminescent display and a demultiplexer, which reduces data programming time of a current programming type pixel.

2. Discussion of Related Art

An organic electroluminescent display is based on a phenomenon that an exciton emits light of a specific wavelength in an organic thin film, wherein the exciton is formed by recombination of an electron and a hole respectively injected from a cathode and an anode. The organic electroluminescent display comprises a self-emitting device, contrary to a liquid crystal display (LCD), so that a separate light source is not needed. In the organic electroluminescent display, the brightness of an organic electroluminescent device varies depending on the quantity of current flowing in an organic electroluminescent device.

The organic electroluminescent display is classified into a passive matrix type and an active matrix type according to driving methods. In the case of the passive matrix type, the anode and the cathode are perpendicularly disposed and form a line to be selectively driven. The passive matrix type organic electroluminescent display can be easily realized due to a relatively simple structure, but is inadequate to realize a large-sized screen because it consumes relatively much power and time taken to drive each light emitting device becomes relatively shorted. On the other hand, in the case of the active matrix type, an active device is used to control the quantity of current flowing in the light emitting device. As the active device, a thin film transistor (hereinafter, referred to as "TFT") is widely used. The active matrix type organic electroluminescent display has a relatively complicated structure, but it consumes relatively small power and time taken to drive each organic electroluminescent device becomes relatively increased.

U.S. Pat. No. 6,787,249 to Satoshi Seo and titled ORGANIC LIGHT EMITTING ELEMENT AND LIGHT EMITTING DEVICE USING THE SAME, and incorporated herein, discusses organic light emitting elements that are bright and have low electric power consumption, and an organic light emitting device using the organic light emitting elements. Organic light emitting elements capable of converting triplet state excitation energy into light emission are manufactured by applying a binuclear complex having triplet excitation state electrons to the organic light emitting elements.

SUMMARY OF THE INVENTION

It is an aspect of the present invention to provide an organic electroluminescent display and a demultiplexer, having a current programming type pixel circuit uniformizing brightness of a screen even when threshold voltage is not uniform, and the demultiplexer placed between a data driver and an organic electroluminescent display panel, thereby reducing time taken to program data of a current programming type pixel.

The forgoing and other aspects of the present invention are achieved by providing an organic electroluminescent display comprising: a plurality of pixels displaying an image corresponding to output data current; a plurality of scan lines to transmit a scan signal to the plurality of pixels; a plurality of output data lines to transmit the output data current to the plurality of pixels; a scan driver outputting the scan signal to the plurality of scan lines; a demultiplexer comprising a plurality of demultiplexing circuits; and a data driver outputting input data current to the demultiplexer, wherein the demultiplexing circuit transmits the input data current after applying pre-charging voltage to the output data line selected among the output data lines in sequence.

Other aspects of the present invention are achieved by providing a demultiplexer comprising: a plurality of demultiplexing circuits; and first through fourth control signal lines to apply first through fourth control signals to the demultiplexing circuit, wherein the demultiplexing circuit alternately selects one of a first output data line and a second output data line in response to the third and fourth control signals, and applying input data current from an input data line after applying pre-charging voltage to the selected output data line.

BRIEF DESCRIPTION OF THE DRAWINGS

A more complete appreciation of the present invention, and many of the attendant advantages thereof, will become readily apparent as the same becomes better understood by reference to the following detailed description when considered in conjunction with the accompanying drawings in which like reference symbols indicate the same or similar components, wherein.

DETAILED DESCRIPTION OF PREFERRED EMBODIMENTS

Hereinafter, preferable embodiments according to the present invention will be described with reference to the accompanying drawings, wherein the preferred embodiments of the present invention are provided to be readily understood by those skilled in the art.

Hereinbelow, a conventional electroluminescent display will be described with reference to FIGS. 1 and 2.

Figure 1:
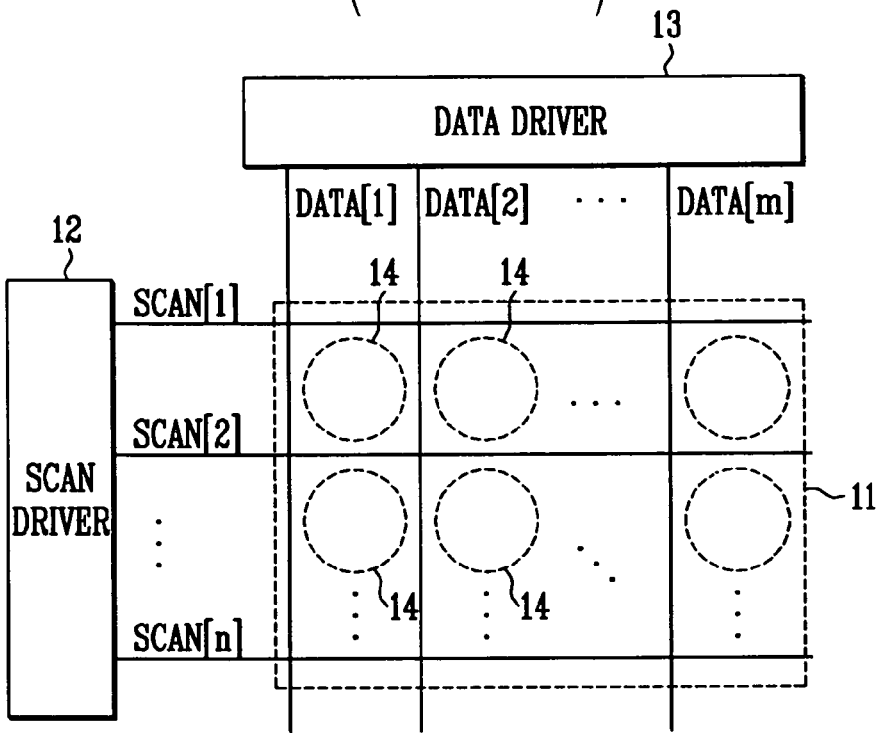
FIG. 1 (PRIOR ART)
FIG. 1 is a view of illustrating a conventional active matrix type n×m organic electroluminescent display.

FIG. 1 is a view of illustrating a conventional active matrix type n×m organic electroluminescent display.

Referring to FIG. 1, the conventional organic electroluminescent display comprises an organic electroluminescent display panel 11, a scan driver 12, and a data driver 13. The organic electroluminescent display panel 11 comprises n×m pixels 14; n scan lines SCAN[1], SCAN[2], . . . , SCAN[n] formed horizontally, and m data lines DATA[1], DATA [2], . . . , DATA[m] formed vertically. Here, the scan driver 12 transmits a scan signal (or gate signal) to the pixels 14 through the scan lines SCAN. Further, the data driver 13 applies data voltage to the pixels 14 through the data lines DATA.

Figure 2:
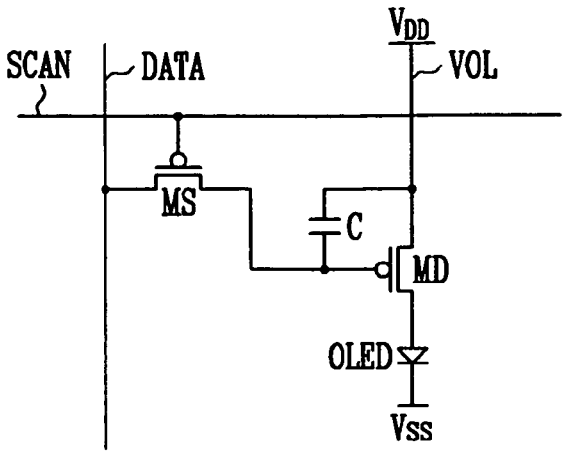
FIG. 2 (PRIOR ART)
FIG. 2 is a circuit diagram of a pixel employed in the conventional organic electroluminescent display.

FIG. 2 is a circuit diagram of a pixel employed in the conventional organic electroluminescent display of FIG. 1.

Referring to FIG. 2, the pixel of the organic electroluminescent display comprises an organic light emitting device OLED, a driving transistor MD, a capacitor C and a switching transistor MS. The driving transistor MD applies current corresponding to voltage applied between two terminals of the capacitor C to the organic electroluminescent display. The capacitor C is connected between a source and a gate of the driving transistor MD, and maintains the data voltage applied through the switching transistor MS for a predetermined period. With this configuration, when the switching transistor MS is turned on in response to the scan signal applied to a gate thereof, the data voltage applied through the data line is stored in the capacitor C. Then, when the switching transistor MS is turned off, the current corresponding to the data voltage stored in the capacitor C is applied to the organic light emitting device OLED through the driving transistor MD, thereby allowing the organic light emitting device OLED to emit light.

At this time, the current flowing in the organic light emitting device OLED is calculated by the following equation, equation 1.

$$I_{OLED}=I_D=(\beta/2)(V_{GS}-V_{TH})^2=(\beta/2)(V_{DD}-V_{DATA}-|V_{TH}|)^2 \quad \text{equation 1}$$

Where $I_{OLED}$ is a current flowing in the organic light emitting device OLED; $I_D$ is a current flowing from the source to a drain of the driving transistor MD; $V_{GS}$ is a voltage applied between the gate and the source of the driving transistor MD; $V_{TH}$ is a threshold voltage of the driving transistor MD; $V_{DD}$ is a power voltage; $V_{DATA}$ is a data voltage; and β is a gain factor.

In the conventional electroluminescent display of FIG. 1, the data driver 13 is directly connected to the data lines DATA of the pixels 14. Therefore, the data driver 13 is complicated in proportion to the number of the data lines DATA. For example, the data driver 13 is realized as a chip separated from the organic electroluminescent display panel 11, the number of pins provided in the data driver 13 and the number of wirings connecting the data driver 13 with the organic electroluminescent display panel 11 are increased in proportion to the number of the data lines DATA, thereby increasing production cost and occupying much space.

Further, in the pixels employed in the conventional organic electroluminescent display, the organic light emitting device OLED emits light corresponding to the current when the current corresponding to the data voltage is applied to the organic light emitting device OLED, wherein a deviation between the threshold voltages VTH of the driving transistors MD, which is due to a non-uniform fabrication process, causes the brightness of a screen to not be uniform. That is, even though the same data voltage is applied to the organic electroluminescent display, some pixels having a low absolute value (|VTH|) of the threshold voltage emit relatively bright light, but some others having a high absolute value (|VTH|) of the threshold voltage emit relatively dark light, thereby causing the screen to have the non-uniform brightness.

Figure 3:
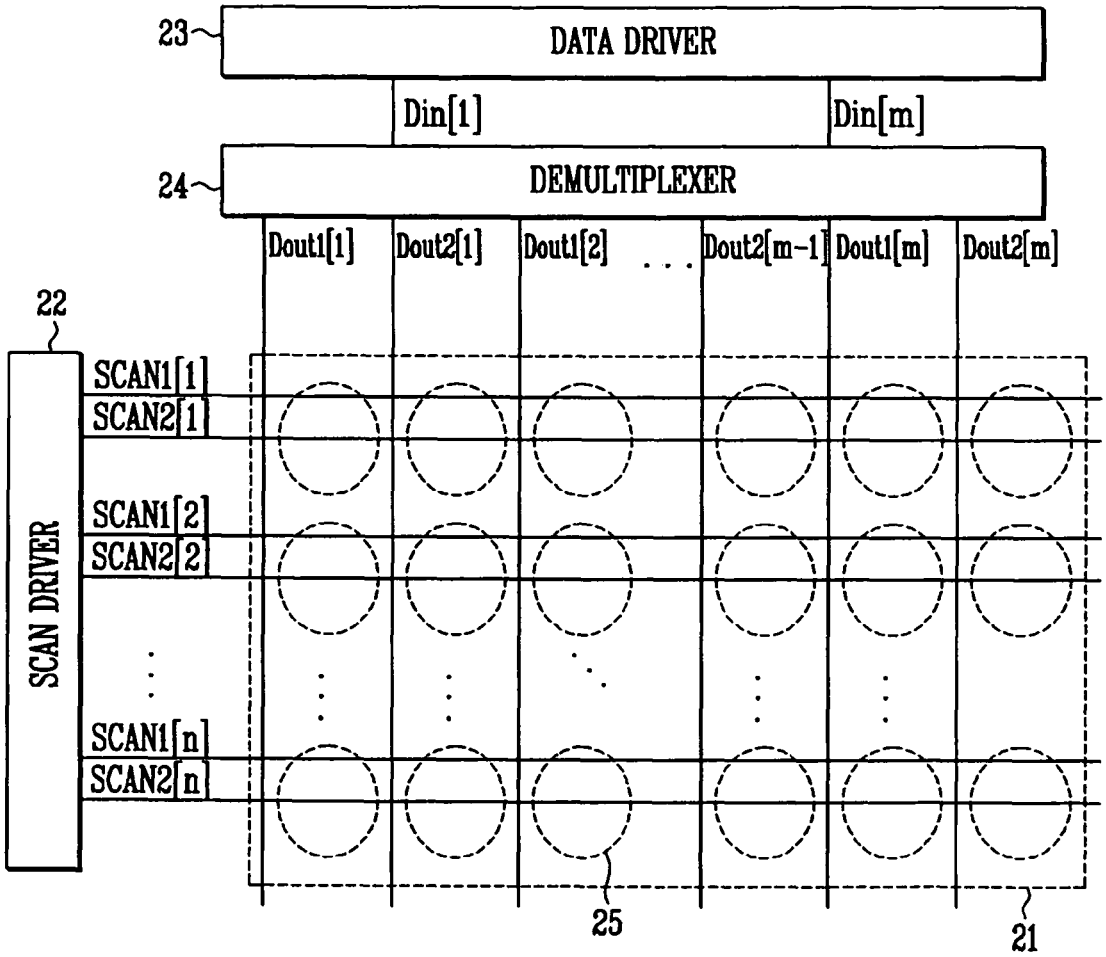
FIG. 3 is a view of illustrating an active matrix type n×2m organic electroluminescent display according to a first embodiment of the present invention.

FIG. 3 is a view of illustrating an active matrix type n×2m organic electroluminescent display according to a first embodiment of the present invention.

Referring to FIG. 3, the organic electroluminescent display according to the first embodiment of the present invention comprises an organic electroluminescent display panel 21, a scan driver 22, a data driver 23, and a demultiplexer 24.

The organic electroluminescent display 21 comprises n×2m pixels 25; n first scan lines SCAN1[1], SCAN1 [2], . . . , SCAN1[*n*], and n second scan lines SCAN2[1], SCAN2[2], . . . , SCAN2[*n*], which are formed horizontally; and 2m output data lines Dout1[1], Dout2[1], . . . , Dout1[*m*], Dout2[*m*] formed vertically. Here, the first and second scan lines SCAN1 and SCAN2 transmit first and second scan signals to the pixels 25, respectively. Further, the output data line Dout1 and Dout2 transmits output data current to the pixels 25. Meanwhile, the pixels 25 operate as a current programming type. According to the current programming type, voltage corresponding to current flowing in the output data lines Dout1 and Dout2 is stored in corresponding capacitors (not shown) during a selection period, and then current corresponding to the voltage stored in the capacitors is supplied to corresponding organic light emitting devices (not shown) during an emitting period.

The scan driver 22 transmits the first and second scan signals to the first and second scan lines SCAN1 And SCAN2.

The data driver 23 transmits input data current to m input data lines Din[1], Din[2], . . . , Din[m].

The demultiplexer 24 receives the input data current and demultiplexes the input data current into the output data current, thereby supplying the output data current to 2m output data lines Dout1[1], Dout2[1], . . . , Dout1[*m*], Dout2[*m*]. Here, the demultiplexer 24 comprises m demultiplexing circuits (not shown). Each demultiplexing circuit is of an 1:2 demultiplexing circuit, so that the input data current inputted to one input data line Din is demultiplexed and outputted to two output data lines Dout1 and Dout2.

Thus, in the organic electroluminescent display according to the first embodiment of the present invention, the demultiplexer 24 is disposed between the organic electroluminescent display panel 21 and the data driver 23, so that the data driver 23 comprising a few outputs can be used for driving the organic electroluminescent display panel 21 comprising many lines. Hence, the structure of the data driver 23 is simplified, and the number of input data lines Din is decreased, thereby decreasing production cost and decreasing occupying space.

Figure 4:
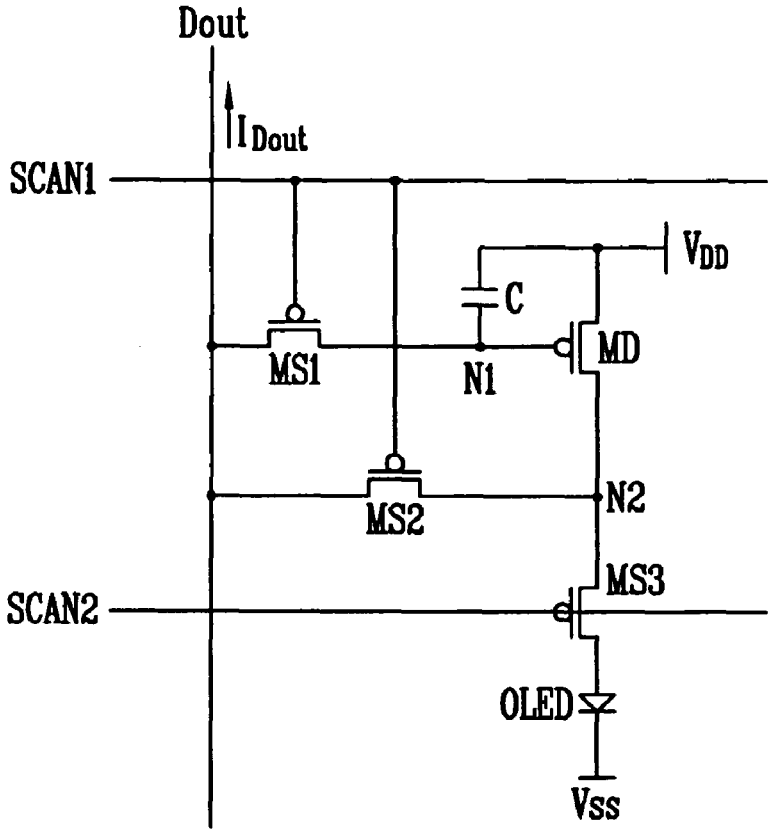
FIG. 4 is a circuit diagram of a pixel employed in the organic electroluminescent display according to the first embodiment of the present invention.

FIG. 4 is a circuit diagram of a pixel employed in the organic electroluminescent display according to the first embodiment of the present invention, wherein the pixel is a current programming type pixel.

Referring to FIG. 4, the pixel comprises an organic light emitting device (OLED) and a pixel circuit. The pixel circuit comprises a driving transistor MD; first through third switching transistors MS1, MS2, MS3; and a capacitor C. Each of the driving transistor MD, and the first through third switching transistors MS1, MS2, MS3 comprises a gate, a source, and a drain. Further, the capacitor C comprises a first terminal and a second terminal.

The first switching transistor MS1 has its gate connected to the first scan line SCAN1, the source connected to a first node N1, and the drain connected to the output data line Dout. The first switching transistor MS1 is used in charging the capacitor C in response to the first scan signal.

The second switching transistor MS2 has its gate connected to the first scan line SCAN1, the source connected to a second node N2, and the drain connected to the output data line Dout. The second switching transistor MS2 is used in supplying the output data current $I_{Dout}$ flowing in the output data line Dout to the driving transistor MD in response to the first scan signal transmitted over the first scan line SCAN1.

The third switching transistor MS3 has its gate connected to the second scan line SCAN2, the source connected to the second node N2, and the drain connected to the organic light emitting device OLED. The third switching transistor MS3 is used in supplying the current flowing in the driving transistor MD to the organic light emitting device OLED in response to the second scan signal transmitted over the second scan line SCAN2.

The capacitor C comprises a first terminal to which power voltage $V_{DD}$ is applied, and a second terminal connected to the first node N1. The capacitor C is charged with the quantity of electric charge corresponding to a voltage ($V_{GS}$) applied between the gate and the source in correspondence with the output data current $I_{Dout}$ flowing in the driving transistor MD while the first and second switching transistors MS1 and MS2 are turned on, and maintains the voltage while the first and second switching transistors MS1 and MS2 are turned off.

The driving transistor MD comprises a gate connected to the first node N1, a source to which the power voltage $V_{DD}$ is applied, and a drain connected to the second node N2. The driving transistor MD is used in supplying the current corresponding to the voltage applied between the first and second terminals of the capacitor to the organic electroluminescent display while the third switching transistor MS3 is turned on.

Figure 5:
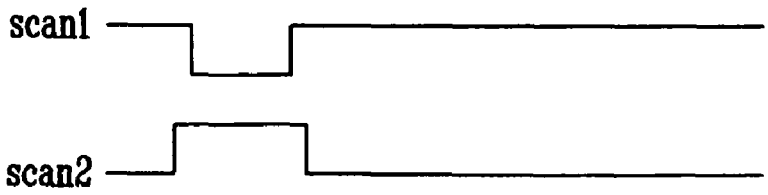
FIG. 5 is a view of illustrating scan signals for driving a pixel circuit with respect to time according to the first embodiment of the present invention.

FIG. 5 is a view of illustrating scan signals for driving a pixel circuit according to the first embodiment of the present invention with respect to time, the scan signal comprise first and second scan signals scan1 and scan2.

Referring to FIGS. 4 and 5, the pixel circuit operates as follows. During the selection period that the first scan signal scan1 is low and the second scan signal scan2 is high, the first and second switching transistors MS1 and MS2 are turned on, but the third switching transistor MS3 is turned off. During this selection period, the output data current $I_{Dout}$ flowing in the output data line Dout is transmitted to the driving transistor MD. At this time, the voltage ($V_{GS}$) applied between the gate and the source of the driving transistor MD is determined by the following equation, equation 2, and the capacitor C is charged with the quantity of electric charge corresponding to the voltage $V_{GS}$ applied between the gate and the source.

$$I_D=I_{Dout}=(\beta/2)(V_{GS}-V_{TH})^2 \quad \text{equation 2}$$

During the light emitting period that the first scan signal scan1 is high and the second scan signal scan2 is low, the third switching transistor MS3 is turned on, but the first and second switching transistors MS1 and MS2 are turned off. The quantity of electric charge charged in the capacitor C during this selection period is maintained during the light emitting period, so that the voltage applied between the first and second terminals of the capacitor C, that is, the voltage applied to the gate and source of driving transistor MD is maintained during the light emitting period. Referring to equation 2, the current $I_D$ flowing in the driving transistor MD is determined depending on the voltage $V_{GS}$ between the source and the drain thereof, so that the output data current $I_{Dout}$ flowing in the driving transistor MD during the selection period is also maintained to be flowing in the driving transistor MD during the light emitting period. Hence, the current $I_{OLED}$ flowing in the organic light emitting device OLED is calculated by the following equation, equation 3.

$$I_{OLED}=I_D=I_{Dout} \quad \text{equation 3}$$

Referring to equation 3, the current $I_{OLED}$ flowing in the organic light emitting device OLED shown in FIG. 4 is equal to the output data current $I_{Dout}$, so that the current $I_{OLED}$ flowing in the organic light emitting device OLED is not affected by the threshold voltage of the driving transistor MD. That is, the pixel circuit according to the present invention is not affected by the threshold voltage of the driving transistor MD, thereby uniformizing the brightness between the pixels of the organic electroluminescent display.

However, the current programming type pixel circuit has to charge and discharge the parasitic capacitor C connected to the output data line Dout, so that there arises a problem that it takes much time to program data. For example, voltage applied to the first node N1 varies corresponding to variation of the output data voltage $I_{Dout}$. The voltage applied to the output data line Dout should be varied to vary the voltage applied to the first node N1, but it takes much time to charge and discharge the parasitic capacitor C connected to the output data line Dout. Therefore, time taken to store voltage corresponding to the output data current $I_{Dout}$ in the capacitor C, that is, time taken to program the data is increased. This phenomenon arises seriously in proportion to the variation of the output data current $I_{Dout}$ and the capacity of the parasitic capacitor C, but in inverse proportion to the intensity of the output data current $I_{Dout}$.

Figure 6:
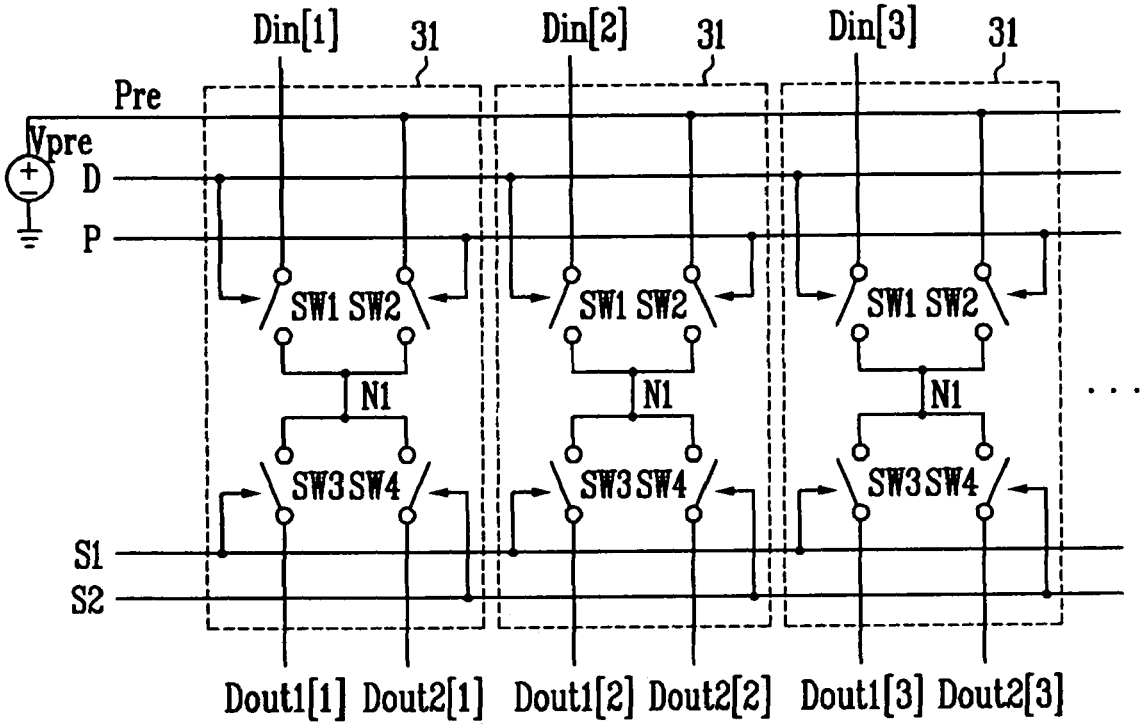
FIG. 6 is a circuit diagram of a demultiplexer employed in the organic light emitting display according to the first embodiment of the present invention.

FIG. 6 is a circuit diagram of a demultiplexer employed in the organic light emitting display according to the first embodiment of the present invention.

Referring to FIG. 6, the demultiplexer comprises m demultiplexing circuits 31. Each demultiplexing circuit 31 selects the first and second output data lines Dout1 and Dout2 alternately, and applies a pre-charging voltage Vpre to the selected output data line Dout1 or Dout2, thereby transmitting the input data current inputted from the input data line Din. For example, each demultiplexing circuit 31 performs the demultiplexing by selecting the first and second output data lines Dout1 and Dout2, alternately, to transmit the selected output data line Dout1 or Dout2, wherein the pre-charging voltage is previously applied to the selected output data line Dout1 or Dout2 before transmitting the input data current to the selected output data line Dout1 or Dout2. Here, the non-selected output data line Dout1 or Dout2 is opened, so that the current does not flow therethrough.

Each demultiplexing circuit 31 comprises first through fourth switches SW1 through SW4, and is connected to the input data line Din, a pre-charging voltage line Pre, the first and second output data lines Dout1 and Dout2, and first through fourth control signal lines D, P, S1, S2.

The first switch SW1 transmits the input data current from the input data line Din to the first node N1 in response to a first control signal applied to the first control signal line D. The second switch SW2 transmits the pre-charging voltage Vpre from the pre-charging voltage line Vpre to the first node N1 in response to a second control signal applied to the second control signal line P.

The third switch SW3 connects the first node N1 with the first output data line Dout1 in response to a third control signal applied to the third control signal line S1. The fourth switch SW4 connects the first node N1 with the second output data line Dout2 in response to a fourth control signal applied to the fourth control signal line S2.

Alternatively, the demultiplexing circuit 31 may not comprise the first switch SW1 and the first control signal line D, wherein the input data line Din is connected to the first node N1 without a switch.

According to an embodiment of the present invention, every demultiplexing circuit 31 is connected with the same pre-charging voltage line Pre. However, each demultiplexing circuit 31 may comprise the pre-charging voltage line separately to apply pre-charging voltages differently to the demultiplexing circuits 31, respectively. Further, the pre-charging voltage Pre can have an invariable value or a variable value with respect to time. In the case where the pre-charging voltage Vpre varies according to time, the pre-charging voltage may be determined on the basis of the input data current $I_{Din}$.

In the demultiplexer according to an embodiment of the present invention, the first and second switches SW1 and SW2, and the first and second control signal lines D and P can be placed on an integrated circuit device. Further, the third and fourth switches SW3 and SW4, and the third and fourth control signal lines S1 and S2 can be placed on a substrate (not shown) such as a glass on which the organic electroluminescent display panel 21 shown in FIG. 3 is provided.

Alternatively, in the demultiplexer according to an embodiment of the present invention, the first switch SW1 and the first control signal line D can be placed on an integrated circuit device. Further, the second through fourth switches SW2, SW3 and SW4, and the second through fourth control signal lines P, S1 and S2 can be placed on the substrate.

Besides, the whole demultiplexer can be placed on the substrate. In this case, the data driver can be placed on the substrate.

Figure 7:
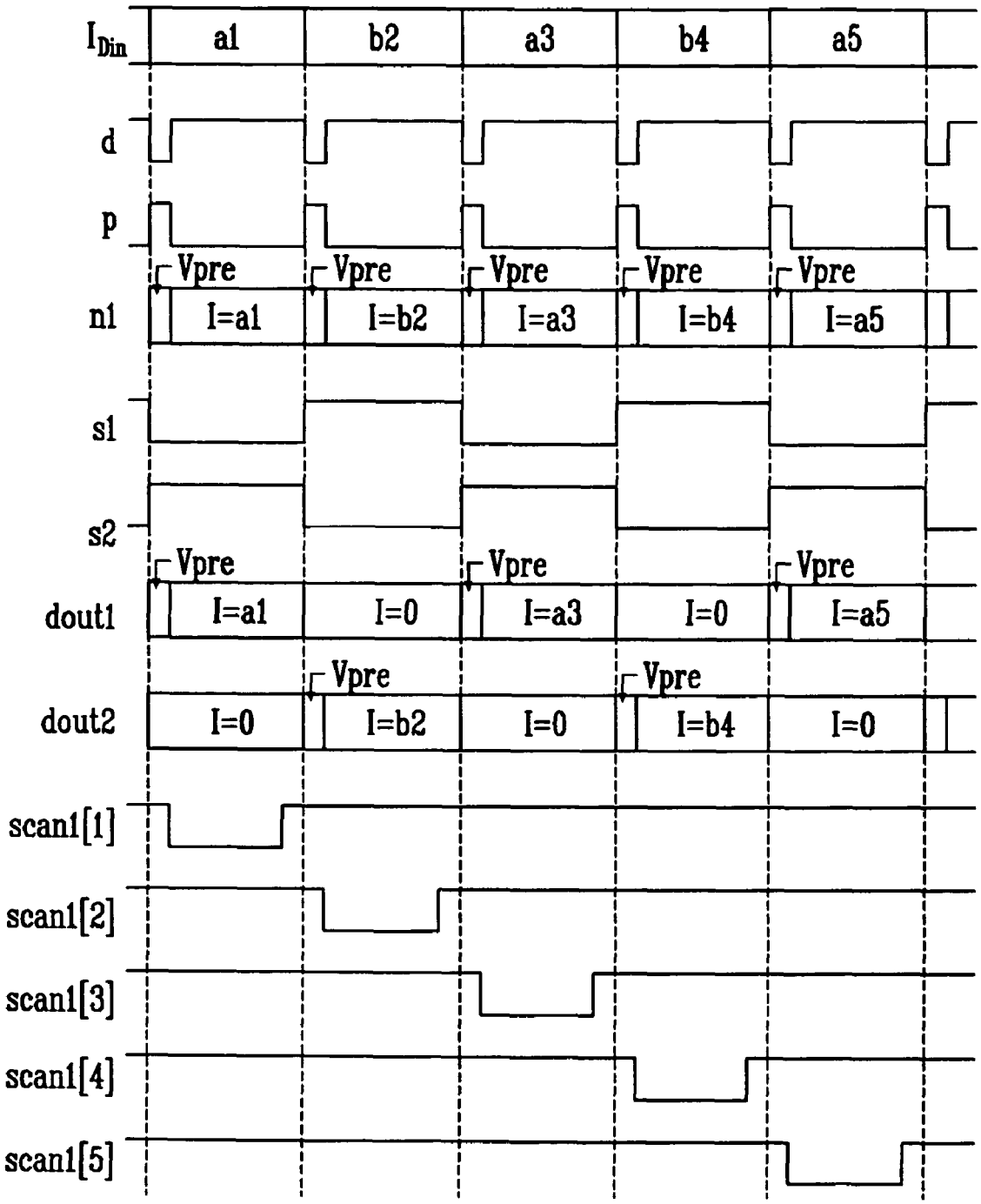
FIG. 7 is a view of illustrating input and output signals of the demultiplexer and a first scan signal according to the first embodiment of the present invention.

FIG. 7 is a view of illustrating input/output signals of the demultiplexer and a first scan signal with respect to time according to the first embodiment of the present invention.

FIG. 7 illustrates an input data current $I_{Din}$; first through fourth control signals d, p, s1, s2; a first node signal n1; first and second output data signal dout1, dout2; and a first scan signal scan1. For convenience, operations of the demultiplexing circuit 31 will be described on the assumption that the first and second switches SW1 and SW2 are turned on when the first and second control signals d and p are high, respectively, and turned off when the first and second control signals d and p are low, respectively. Likewise, it is assumed that the third and fourth switches SW3 and SW4 are turned off when the third and fourth control signals s1 and s2 are high, respectively, and turned on when the third and fourth control signals s1 and s2 are low, respectively.

Referring to FIGS. 3, 6 and 7, while the first control signal d is low and the second control signal p is high, the first switch SW1 is turned off in response to the low first control signal d applied to the first control signal line D, and the second switch SW2 is turned on in response to the high second control signal p applied to the second control signal line P, thereby applying the pre-charging voltage Vpre to the first node N1. While the first control signal d is high and the second control signal p is low, the first switch SW1 is turned on, and the second switch SW2 is turned off, thereby applying the input data current $I_{Din}$ to the first node N1. Thus, the first node signal n1 alternates between the pre-charging voltage Vpre and the input data current $I_{Din}$.

While the third control signal s1 is low and the fourth control signal s2 is high, the third switch SW3 is turned on in response to the low third control signal s1 applied to the third control signal line S1, and the fourth switch SW4 is turned off in response to the high fourth control signal s2 applied to the fourth control signal line S2. At this period of time, the first output data line Dout1 is connected to the first node N1, thereby outputting the first node signal n1, but the second output data line Dout2 is opened, thereby outputting a current of 0 A. Further, while the third control signal s1 is high and the fourth control signal s2 is low, the third switch SW3 is turned off and the fourth switch SW4 is turned on. At this period of time, the first output data line Dout1 is opened, thereby outputting a current of 0 A, but the second output data line Dout2 is connected to the first node signal n1, thereby outputting the first node signal n1. Thus, the input data current $I_{Din}$ is transmitted to one of the first and second output data lines Dout1 and Dout2, and a current of 0 A flows in the other one. Meanwhile, the selected output data line previously receives the pre-charging voltage Vpre before receiving the input data current $I_{Din}$.

The foregoing description can be appreciated from a different angle as follows. Each of first through fourth control signals d, p, s1, s2 are a periodic signal, and one cycle of each signal includes first through fourth periods. During the first period, the first control signal d is low, the second control signal p is high, the third control signal s1 is low, and the fourth control signal s2 is high. Therefore, during the first period, the pre-charging voltage Vpre is applied to the first output data line Dout1, and a current of 0 A is applied to the second output data line Dout2. During the second period, the first control signal d is high, the second control signal p is low, the third control signal s1 is low, and the fourth control signal s2 is high. Therefore, during the second period, the input data current $I_{Din}$ is applied to the first output data line Dout1, and a current of 0 A is applied to the second output data line Dout2. During the third period, the first control signal d is low, the second control signal p is high, the third control signal s1 is high, and the fourth control signal s2 is low. Therefore, during the third period, a current of 0 A is applied to the first output data line Dout1, and the pre-charging voltage Vpre is applied to the second output data line Dout2. During the fourth period, the first control signal d is high, the second control signal p is low, the third control signal s1 is high, and the fourth control signal s2 is low. Therefore, during the fourth period, a current of 0 A is applied to the first output data line Dout1, and the input data current $I_{Din}$ is applied to the second output data line Dout2.

Meanwhile, the pixel operates in response to the first scan signal scan1 as follows. While the first scan signal scan1[1] applied to the first scan line SCAN1[1] of a first line is low, the signals from the first and second output data lines Dout1, Dout2 are transmitted to the pixel located on the first line. Among the pixels located on the first line, the pixels connected to the first output data line Dout1 stores a voltage corresponding to a current a1 transmitted from the input data line Din and then emits light corresponding to the stored voltage during the light emitting period. Among the pixels located on the first line, the pixels connected to the second output data line Dout2 receives a current of 0 A from the input data line Din and thus does not emit light during the light emitting period as a black state. In this embodiment, the pre-charging voltage Vpre is previously applied to the first output data line Dout1 before the first scan signal scan1[1] of the first line is altered into a low state. Alternatively, the pre-charging voltage Vpre may be applied to the first output data line Dout1 after the first scan signal scan1[1] of the first line is altered into the low state. In this case, the pre-charging voltage Vpre is applied to not only the first output data line Dout1 but also the pixel located on the first line and connected to the first output data line Dout1.

Further, while the first scan signal scan1[2] applied to the first scan line SCAN1[2] of a second line is low, the signals from the first and second output data lines Dout1, Dout2 are transmitted to the pixel located on the second line. Among the pixels located on the second line, the pixel connected to the first output data line Dout1 receives a current of 0 A from the input data line Din and thus does not emit light during the light emitting period as a black state. Among the pixels located on the second line, the pixel connected to the second output data line Dout2 stores a voltage corresponding to a current b2 transmitted from the input data line Din and then emits light corresponding to the stored voltage during the light emitting period. In this embodiment, the pre-charging voltage Vpre is previously applied to the second output data line Dout2 before the first scan signal scan1[2] of the second line is altered into a low state.

Likewise, among the pixels located on a third line, the pixel connected to the first output data line Dout1 emits light corresponding to a current a3 transmitted from the input data line Din, and the pixel connected to the second output data line Dout2 is in a black state. Here, the pre-charging voltage Vpre is applied to the first output data line Dout1 before the first scan signal scan1[3] of the third line is altered into a low state. Further, among the pixels located on a fourth line, the pixel connected to the first output data line Dout1 is in a black state, and the pixel connected to the second output data line Dout2 emits light corresponding to a current b4 transmitted from the input data line Din. Here, the pre-charging voltage Vpre is applied to the second output data line Dout2 before the first scan signal scan1[4] of the forth line is altered into a low state. Also, among the pixels located on a fifth line, the pixel connected to the first output data line Dout1 emits light corresponding to a current a5 transmitted from the input data line Din, and the pixel connected to the second output data line Dout2 is in a black state. Here, the pre-charging voltage Vpre is applied to the first output data line Dout1 before the first scan signal scan1[5] of the fifth line is altered into a low state.

As described above, in the demultiplexer according to an embodiment of the present invention, the pre-charging voltage Vpre is applied to the output data line Dout1, Dout2 before applying the input data current $I_{Din}$ thereto, thereby reducing time taken to charge and discharge the parasitic capacitor C provided in the output data line Dout. Therefore, it is possible to reduce time taken to program data in the pixel connected to the output data line Dout. Further, the pre-charging voltage is applied during a period between the period of time when the first scan signal scan1[1] of the first line is low and the period of time when the first scan signal scan1[2] of the second line is low, so that time taken for pre-charging is not additionally needed.

Figure 8:
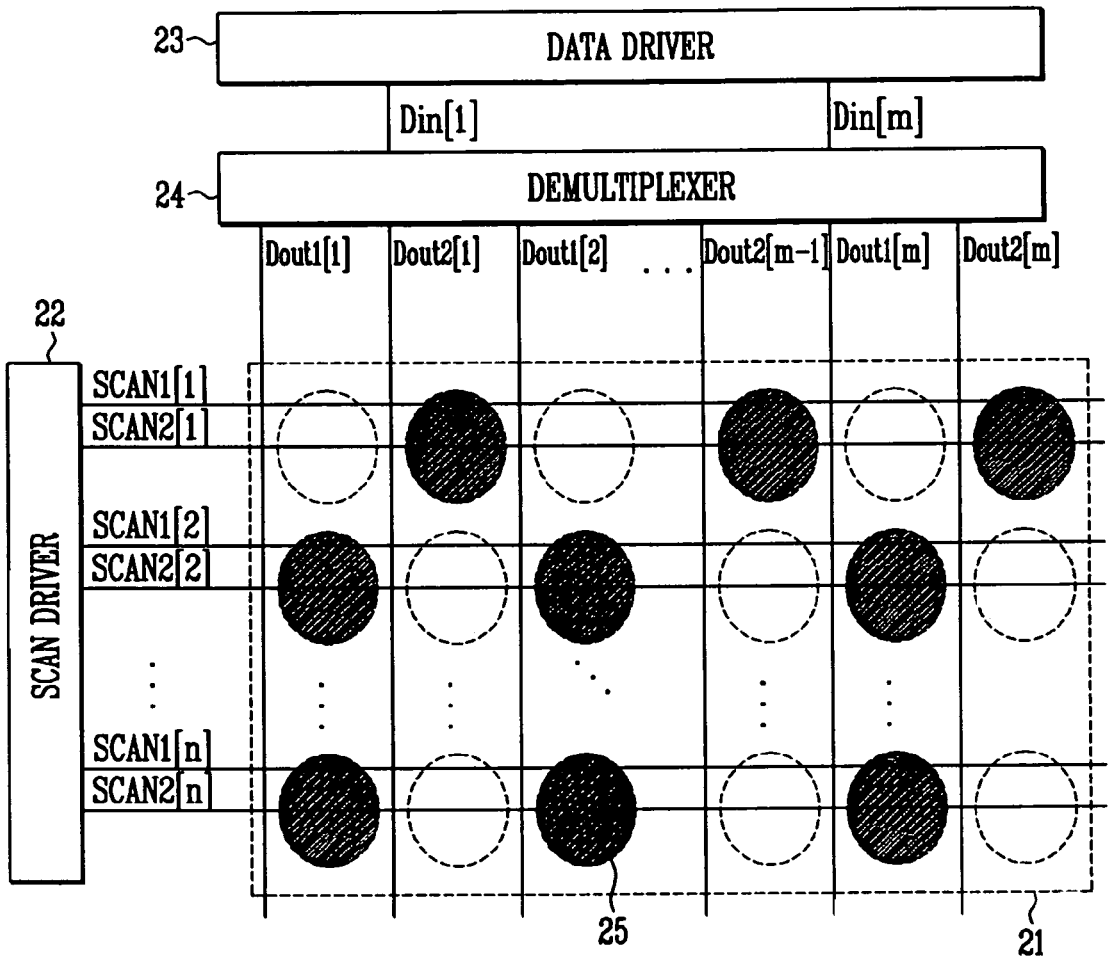
FIGS. 8 and 9 are views of illustrating on/off control of the pixels at an odd numbered frame and an even numbered frame in the organic electroluminescent display operating on the basis of the signals shown in FIG. 7.
Figure 9:
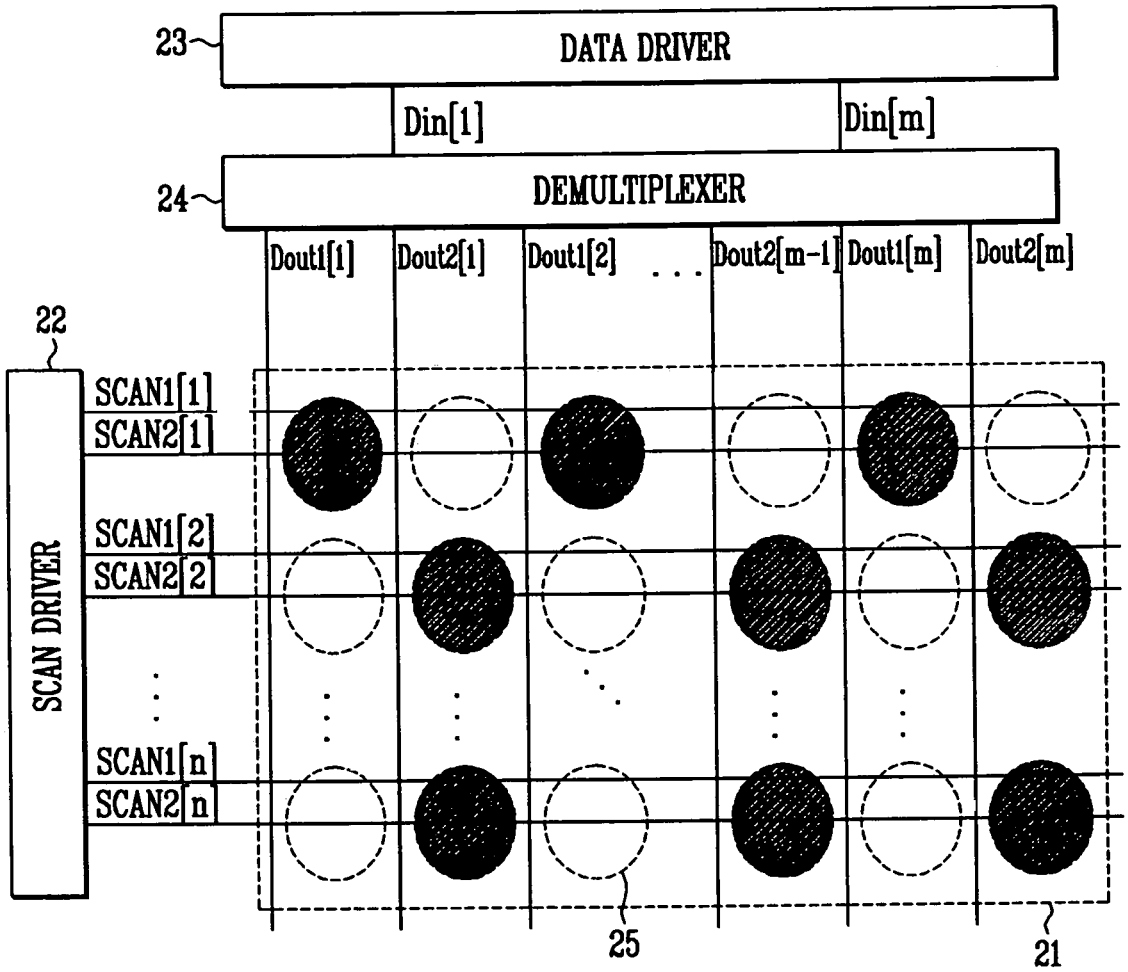

FIGS. 8 and 9 are views of illustrating on/off control of the pixels at an odd numbered frame and an even numbered frame in the organic electroluminescent display operating on the basis of the signals shown in FIG. 7.

In FIG. 8 illustrating an on/off state of each pixel at the odd numbered frame, the pixels of an odd numbered line among the pixels connected to the first output data line Dout1 emit light, but those of the even numbered line are in the black state. Further, the pixels of the odd numbered line among the pixels connected to the second output data line Dout2 are in the black state, but those of the even numbered line emit light. On the other hand, in FIG. 9 illustrating an on/off state of each pixel at the even numbered frame, the pixels of the odd numbered line among the pixels connected to the first output data line Dout1 are in the black state, but those of the even numbered line emit light. Further, the pixels of the odd numbered line among the pixels connected to the second output data line Dout2 emit light, but those of the even numbered line are in the black state. Thus, the on/off state of the odd numbered frame can be controlled by the signals as shown in FIG. 7, and the on/off state of the even numbered frame can be controlled by the signals as shown in FIG. 7 of which the third and fourth control signals are exchanged with each other.

Figure 10:
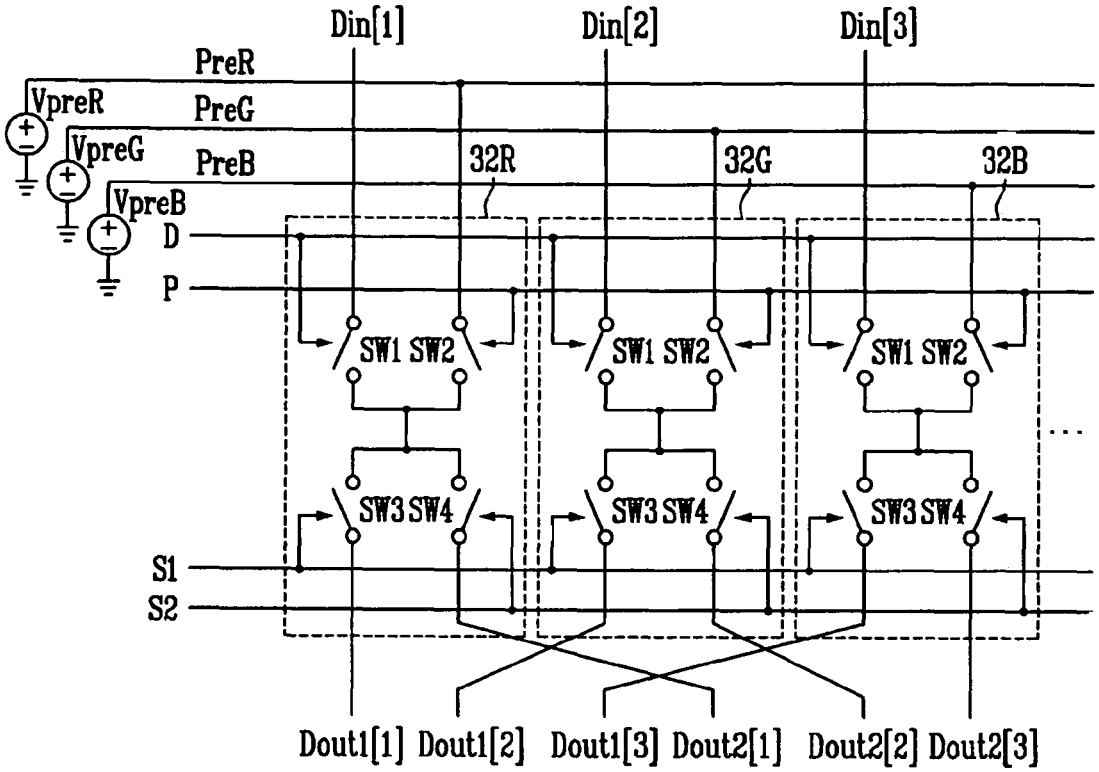
FIG. 10 is a circuit diagram of a demultiplexer employed in an organic electroluminescent display according to a second embodiment of the present invention.

FIG. 10 is a circuit diagram of a demultiplexer employed in an organic electroluminescent display according to a second embodiment of the present invention.

In FIG. 10, a demultiplexer according to the second embodiment of the present invention comprises m demultiplexing circuits 32R, 32G and 32B. Each of the demultiplexing circuits 32R, 32G and 32B has the same configuration and the same function as that according to the first embodiment. However, contrary to the first embodiment, each of the demultiplexing circuits 32R, 32G and 32B according to the second embodiment comprises first and second output data lines Dout1, Dout2 respectively connected to one pixel, i.e., to the same color pixel. For example, the first and second output data lines Dout1 and Dout2 of the demultiplexing circuit 32R are connected to a red pixel; the first and second output data lines Dout1 and Dout2 of the demultiplexing circuit 32G are connected to a green pixel; the first and second output data lines Dout1 and Dout2 of the demultiplexing circuit 32R are connected to a blue pixel.

Further, contrary to the first embodiment, the demultiplexing circuits 32R, 32G and 32B employ three pre-charging voltage lines PreR, PreG and PreB, respectively. For example, a red pre-charging voltage line PreR is used for supplying the pre-charging voltage VpreR to the demultiplexing circuit 32R connected to the red pixel; a green pre-charging voltage line PreG is used for supplying the pre-charging voltage VpreG to the demultiplexing circuit 32G connected to the green pixel; and a blue pre-charging voltage line PreB is used for supplying the pre-charging voltage VpreB to the demultiplexing circuit 32B connected to the blue pixel. With this configuration, the pre-charging voltage can be differently supplied to the red, green and blue pixels. For example, the red, green and blue pixels can request pre-charging voltages different from each other, respectively. Correspondingly, the different pre-charge voltages can be supplied to the red, green and blue pixels. Here, the respective pre-charging voltages VpreR, VpreG, VpreB can be constant or vary with respect to time.

As described above, the present invention provides an organic electroluminescent display and a demultiplexer, in which comprises a current programming type pixel circuit uniformizing brightness of a screen even if threshold voltage is not uniform, and the demultiplexer placed between a data driver and an organic electroluminescent display panel, thereby reducing time taken to program data of a current programming type pixel.

Although a few embodiments of the present invention have been shown and described, it would be appreciated by those skilled in the art that changes might be made in this embodiment without departing from the principles and spirit of the invention, the scope of which is defined in the claims and their equivalents. For example, the demultiplexer according to the foregoing embodiments describes a 1:2 demultiplexing circuit, but is not limited thereto and may be a 1:3 demultiplexing circuit, a 1:4 demultiplexing circuit, or etc.

What is claimed is:

1. An organic electroluminescent display comprising:

a plurality of pixels for displaying an image corresponding to output data current;

a plurality of scan lines, each scan line transmitting a scan signal to corresponding ones of said plurality of pixels;

a plurality of output data lines to transmit the output data current to the plurality of pixels;

a scan driver outputting the scan signals to the plurality of scan lines;

a demultiplexer comprising a plurality of demultiplexing circuits and a plurality of pre-charging voltage lines, each of the demultiplexing circuits being coupled to at least two of the output data lines, a pre-charging voltage being supplied to the each of the demultiplexing circuits through one of the pre-charging voltage lines; and a data driver outputting input data current to the demultiplexer, the each of the demultiplexing circuits selecting an output data line among the at least two of the output data lines, the each of the demultiplexing circuits sequentially transmitting the pre-charging voltage and the input data current to the selected output data line while the selected output data line is being selected, one pixel connected to one of the at least two of output data lines and another pixel connected to another of the at least two of output data lines being equivalent in color, the each of the pre-charging voltage lines supplying the pre-charging voltage to the demultiplexing circuits connected to the same color pixel, wherein the demultiplexing circuit operates periodically, and one cycle of the operation comprises first through fourth periods in sequence, and the demultiplexing circuit applies the pre-charging voltage to the first output data line during the first period; applies the input data current to the first output data line during the second period; applies the pre-charging voltage to the second output data line during the third period; and applies the input data current to the second output data line during the fourth period.

2. The organic electroluminescent display according to claim 1, wherein the plurality of scan lines comprise a plurality of first scan lines and a plurality of second scan lines, and each pixel comprises an organic light emitting device, first through third switching transistors, a driving transistor, and a capacitor.

3. The organic electroluminescent display according to claim 2, wherein the first switching transistor allows the capacitor to be charged in response to a first scan signal applied to the first scan line;

the second switching transistor transmits the output data current from the output data line to the driving transistor in response to the first scan signal applied to the first scan line;

the third switching transistor transmits the current from the driving transistor to the organic light emitting device in response to a second scan signal applied to the second scan line;

the capacitor is charged with the quantity of electric charge corresponding to voltage applied between a gate and a source of the driving transistor in correspondence with a current flowing in the driving transistor while the first and second switching transistors are turned on, and maintains the voltage while the first and second switching transistors are turned off, and the driving transistor supplies current corresponding to a voltage applied between first and second terminals of the capacitor to the organic electroluminescent display while the third switching transistor is turned on.

4. The organic electroluminescent display according to claim 2, wherein the first switching transistor comprises a gate connected to the first scan line, a source connected to a first node, and a drain connected to the output data line;

the second switching transistor comprises a gate connected to the first scan line, a source connected to a second node, and a drain connected to the output data line;

the third switching transistor comprises a gate connected to the second scan line, a source connected to the second node, and a drain connected to the organic light emitting device;

the capacitor comprises the first terminal to which a power voltage is applied, and the second terminal connected to the first node; and the driving transistor comprises the gate connected to the first node, the source to which the power voltage is applied, and a drain connected to the second node.

5. The organic electroluminescent display according to claim 2, wherein the first scan signal transmitted to the first scan line and the second scan signal transmitted to the second scan line are of a periodic signal, and one cycle of the first and second scan signal comprises a selection period and a light emitting period, the first scan signal is set to make the first and second switching transistors be turned on during the selection period and be turned off during the light emitting period, and the second scan signal is set to make the third switching transistor be turned off during the selection period and be turned on during the light emitting period.

6. The organic electroluminescent display according to claim 1, wherein the each of demultiplexing circuits comprises:

a first switch to transmit the input data current to a first node in response to a first control signal applied to a first control signal line;

a second switch to transmit the pre-charging voltage from the one of pre-charging voltage lines to the first node in response to a second control signal applied to a second control signal line;

a third switch to connect the first node with the first output data line in response to a third control signal applied to a third control signal line; and a fourth switch to connect the first node with the second output data line in response to a fourth control signal applied to a fourth control signal line.

7. The organic electroluminescent display according to claim 6, wherein the pre-charging voltage lines of the demultiplexer are connected to each other.

8. The organic electroluminescent display according to claim 6, wherein the pre-charging voltage has a constant level.

9. The organic electroluminescent display according to claim 6, wherein the pre-charging voltage varies corresponding to the input data current.

10. The organic electroluminescent display according to claim 6, wherein the first through fourth control signals are of a periodic signal, and one cycle of the first through fourth control signals comprises first through fourth periods;

the first control signal is set to make the first switch be turned off during the first and third periods and be turned on during the second and fourth periods;

the second control signal is set to make the second switch be turned on during the first and third periods and be turned off during the second and fourth periods;

the third control signal is set to make the third switch be turned on during the first and second periods and be turned off during the third and fourth periods; and the fourth control signal is set to make the fourth switch be turned off during the first and second periods and be turned on during the third and fourth periods.

11. The organic electroluminescent display according to claim 6, wherein the first switch and the first control signal line are placed on an integrated circuit device comprising the data driver.

12. The organic electroluminescent display according to claim 6, wherein the first switch, the second switch, the first control signal line, and the second control signal line are placed on an integrated circuit device comprising the data driver.

13. A demultiplexer comprising:

a plurality of demultiplexing circuits;

first through fourth control signal lines to apply first through fourth control signals to each of the demultiplexing circuits;

a plurality of pre-charging voltage lines; and a first and a second output data lines connected to each of the demultiplexing circuits, each of the demultiplexing circuits alternately selecting one of the first and second output data lines in response to the third and fourth control signals, each of the pre-charging voltage lines supplying a pre-charging voltage to at least one of the demultiplexing circuits, each of the demultiplexing circuits sequentially applying the pre-charging voltage and input data current from an input data line to the selected output data line during the selection, a pixel connected to the first output data line and another pixel connected to the second output data line being equivalent in color, the each of the precharging voltage lines supplying the pre-charging voltage to the demultiplexing circuits connected to the same color pixel, wherein the demultiplexing circuit operates periodically, and one cycle of the operation comprises first through fourth periods in sequence, and the demultiplexing circuit applies the pre-charging voltage to the first output data line during the first period; applies the input data current to the first output data line during the second period; applies the pre-charging voltage to the second output data line during the third period; and applies the input data current to the second output data line during the fourth period.

14. The demultiplexer according to claim 13, wherein the pre-charging voltage varies corresponding to the input data current.

15. The demultiplexer according to claim 13, wherein the demultiplexing circuit comprises:

a first switch to transmit the input data current to a first node in response to the first control signal;

a second switch to transmit the pre-charging voltage to the first node in response to the second control signal;

a third switch to connect the first node with the first output data line in response to the third control signal; and a fourth switch to connect the first node with the second output data line in response to the fourth control signal.

16. The demultiplexer according to claim 15, wherein the first through fourth control signals are of a periodic signal, and one cycle of the first through fourth control signals comprises first through fourth periods, the first control signal is set to make the first switch be turned off during the first and third periods and be turned on during the second and fourth periods;

the second control signal is set to make the second switch be turned on during the first and third periods and be turned off during the second and fourth periods;

the third control signal is set to make the third switch be turned on during the first and second periods and be turned off during the third and fourth periods; and the fourth control signal is set to make the fourth switch be turned off during the first and second periods and be turned on during the third and fourth periods.

* * * * *